US005828934A

United States Patent [19]

Tamura et al.

[11] Patent Number: 5,828,934

[45] Date of Patent: Oct. 27, 1998

[54] DRIVING DEVICE OF DEVELOPING UNITS AND TONER REPLENISHING UNITS FOR USE IN IMAGE FORMING APPARATUS

[75] Inventors: Takashi Tamura; Yozo Fujii; Kenji Sato; Masahiro Shigetomi; Isao Matsuoka, all of Hachioji, Japan

[73] Assignee: Konica Corporation, Japan

[21] Appl. No.: 668,498

[22] Filed: Jun. 4, 1996

[30] Foreign Application Priority Data

| | | | |
|---|---|---|---|
| Jun. 7, 1995 | [JP] | Japan | 7-140515 |
| Aug. 23, 1995 | [JP] | Japan | 7-214694 |
| Sep. 1, 1995 | [JP] | Japan | 7-225204 |

[51] Int. Cl.[6] ..... G03G 15/00; G03G 21/00

[52] U.S. Cl. ..... 399/228

[58] Field of Search ..... 399/107, 119, 399/225, 227, 228

[56] References Cited

U.S. PATENT DOCUMENTS

| | | | |
|---|---|---|---|
| 3,987,756 | 10/1976 | Katayama et al. | 399/227 |
| 4,477,173 | 10/1984 | Kozuka et al. | 399/255 |
| 4,954,845 | 9/1990 | Yano et al. | 399/329 |
| 5,298,948 | 3/1994 | Kurisu | 399/119 |
| 5,585,598 | 12/1996 | Kasahara et al. | 399/227 |
| 5,585,898 | 12/1996 | Fujii | 399/228 |
| 5,612,769 | 3/1997 | Sugihara et al. | 399/228 X |
| 5,633,699 | 5/1997 | Aruga et al. | 399/107 |
| 5,663,804 | 9/1997 | Kataoka et al. | 399/385 X |

*Primary Examiner*—Fred L. Braun

*Attorney, Agent, or Firm*—Jordan B. Bierman; Bierman, Muserlian and Lucas

[57] ABSTRACT

A revolution control for a sun and planetary gear system including supporting members for the planetary gears which are revolvable around the same gear and a cam mechanism engaging a portion of the supporting member. The cam mechanism includes a cam shaft carrying a plurality of cams and there is a driving gear engaging the cam shaft. Also, two transmission gear trains present permit the driving gears to operate in either direction while still driving the toner replenishers in the same direction.

13 Claims, 14 Drawing Sheets

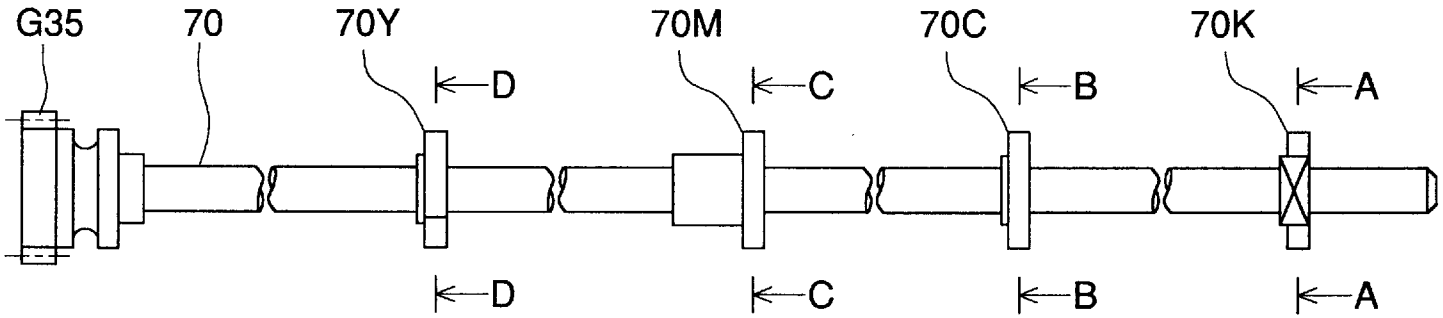
FIG. 9 ( a )
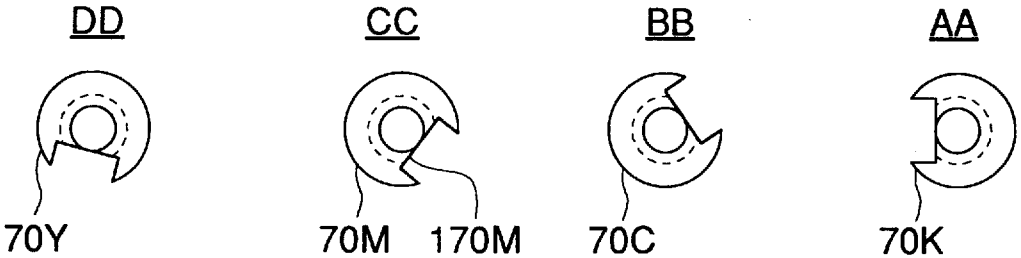
FIG. 9 ( e ) FIG. 9 ( d ) FIG. 9 ( c ) FIG. 9 ( b )

DRIVING DEVICE OF DEVELOPING UNITS AND TONER REPLENISHING UNITS FOR USE IN IMAGE FORMING APPARATUS

BACKGROUND OF THE INVENTION

The present invention relates to a driving device which rotates plural developing devices integral with a color image forming apparatus and conducts toner replenishing driving for replenishing toner in aforesaid device.

It is ordinary that a color image forming apparatus is provided with plural toner replenishing devices and plural developing devices.

The above-mentioned device consumes toner inside developing devices when forming a color image.

Accordingly, since reduction of image density occurs if images are formed after the toner is used up, it is necessary to select a toner replenishing device of specific color to be replenished to a developing device among plural toner replenishing devices.

In addition, in order to form color images in the above-mentioned device, it is necessary to select a developing device successively from plural developing devices for driving.

Therefore, in conventional color image forming apparatuses, driving power was transferred from the driving source to a toner replenishing device and a developing device to be selected by the use of a spring clutch and an electromagnetic clutch for a driving device.

When plural toner replenishing devices or plural developing devices are selected and driving power is transferred using a spring clutch, this mechanism can be realized inexpensively with a simple structure.

However, when driving power is transferred using a spring clutch, there is a problem that idling torque of a spring clutch is not stable. For example, the above-mentioned idling torque is increased as mechanical cycle is increased, idling torque value which is allowable at the initial stage cannot be provided and reliability of a spring clutch itself is problematic.

Th is results in that normal development cannot be conducted and deterioration of image quality is caused in the case of a developing device, and also results in that deterioration of image density due to insufficient toner concentration is caused in the case of toner replenishing means.

When plural toner replenishing devices or plural developing devices are selected and driving power is transferred using an electromagnetic clutch, driving power excellent in terms of reliability can be transferred with sure selection.

However, plural electrical wiring for electroclutch must be provided inside the image forming apparatus. As a result, there is a possibility that complicated structure is needed and expensive cost is required compared to a spring clutch.

As described above, when using a spring clutch or an electromagnetic clutch, both types have merits and demerits. Therefore, they could not be said to be the most suitable driving device.

SUMMARY OF THE INVENTION

An object of the present invention is to transmit driving power at low cost and with a simple structure, while keeping high reliability.

Further, to provide a driving device, which switches developing devices due to switch of rotation direction of the driving motor, in an image forming apparatus capable of transferring the power of the driving motor with an extremely simple mechanism to the toner replenishing driving system as power having a prescribed rotation direction at any time irrelevant to the change of the rotation direction of the driving motor, when driving to the toner replenishing device is obtained from the common motor.

The embodiment for attaining the above-mentioned object is as follows.

A driving device for a plurality of rotatable members of an image forming apparatus, comprising:

a driving means, a plurality sets of sun gear and planetary gear, wherein said driving means connects said plurality of sun gears, and transmits a driving force thereof, a plurality of follower gears each connecting to said plurality of rotatable members, and each transmitting a driving force thereof, wherein each follower gear is engaged with said planetary gear when said planetary gear revolves around corresponding sun gear, and is rotated by said planetary gear when said planetary gear revolves on the axis thereof under an engagement with follower gear, revolution control means for controlling each said planetary gear around said sun gear. dr

DETAILED DESCRIPTION OF THE PREFERRED EMBODIMENT

Prior to explaining examples for attaining the first and the second objects, one example of a color image forming apparatus equipped with the driving device of the present invention will now be explained referring to FIGS. 1 and 2.

Figure 1:
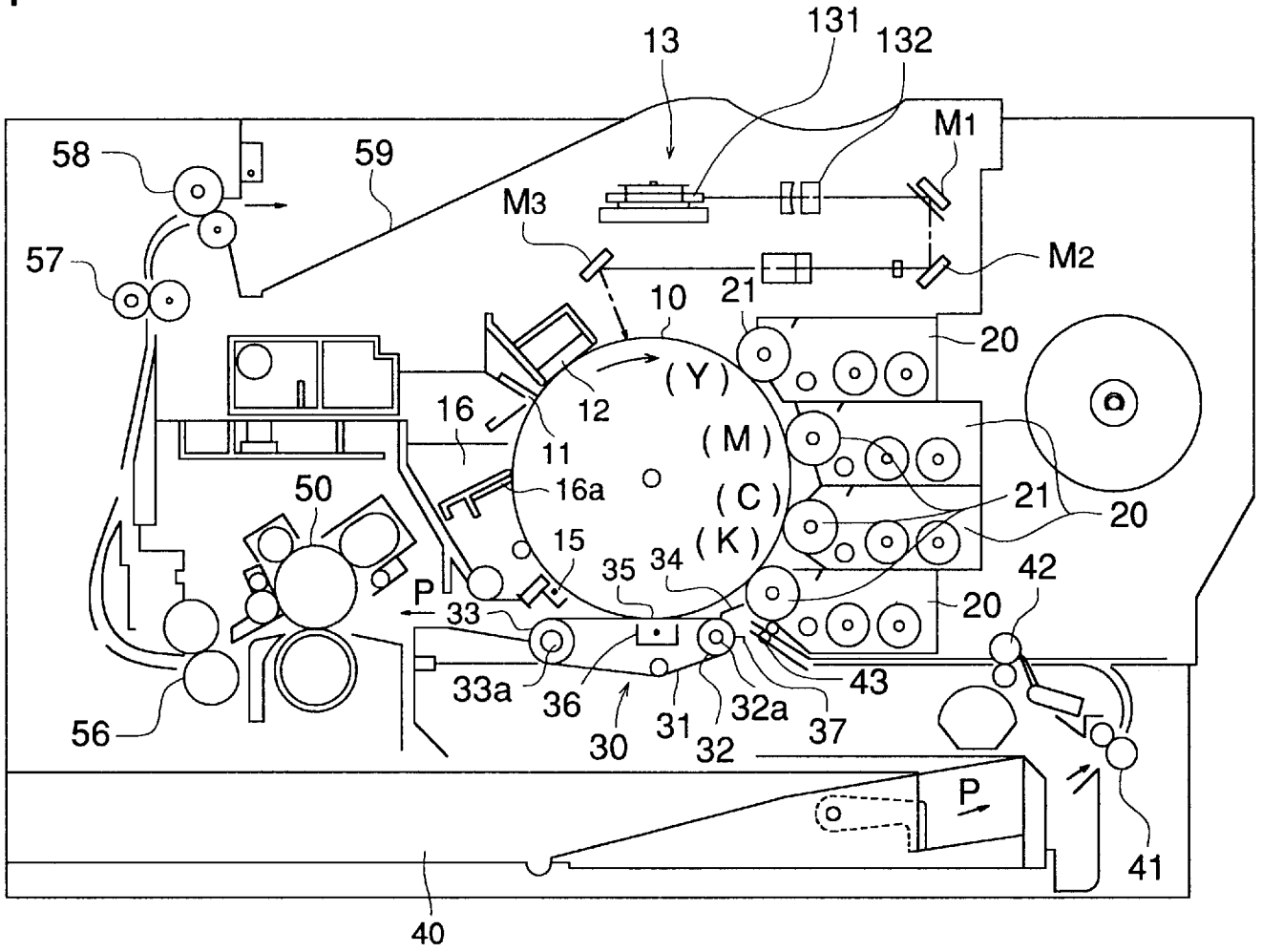
FIG. 1 is a cross-sectional schematic diagram of a color image forming apparatus.

FIG. 1 is a schematic diagram showing one example of a color image forming apparatus of the present invention.

In FIG. 1, numeral 10 is a photoreceptor drum which is an image carrier. For example, it is a drum coated with an OPC photoreceptor thereon, and is electrically grounded and is driven to be rotated clockwise. Numeral 12 is a scorotron charger, which provides uniform negative charge on the circumference surface of photoreceptor drum 10 due to corona discharge by means of grids kept at a prescribed potential and a corona discharge wire for giving $V_H$ potential. Prior to charging by means of the above-mentioned scorotron charger, in order to remove any trace of images on the photoreceptor from the preceding print, the photoreceptor drum is subjected to exposure to light by means of PCL 11 using a light emitting diode so that the circumference of the photoreceptor is discharged.

After uniform charging of the photoreceptor drum 10, the photoreceptor surface is subjected to image exposure by an image signal from a laser writing device. In this image exposure, the image signal inputted from a computer or an image reading device is processed in an image signal processing unit, and then, is inputted to laser writing device 13 so that latent images are formed on photoreceptor drum 10.

Laser writing device 13 employs a laser diode as a light emitting source, and passes through a rotating polygonal mirror 131 and fθlens 132. Its light path is bent by means of plural reflection mirrors M1, M2 and M3 so that the image is subjected to main scanning. Due to the rotation of photoreceptor drum 10, the image is subjected to sub-scanning so that latent images are formed. In the present example, an image area which is an image forming region on the image carrier is subjected to exposure to light by the above-mentioned image signal so that reverse latent images whose absolute value of potential in the light exposure portion is $V_L$ which is lower than $V_H$ are formed.

At the periphery of photoreceptor drum 10, developing devices 20 (Y, M, C, K) which respectively house yellow (Y), magenta (M), cyan (C) and black (K) developers including negatively charged conductive toners and magnetic carriers. Development for the first color is conducted by developing sleeve 21 which is a rotating developer carrier wherein a magnet is built-in and a developer is housed. The developer is held and regulated on developing sleeve 21 wherein the thickness of the developer is controlled to 0.05–0.5 mm (which is the thickness of the developer layer on the developer carrier in the development gap, and is thickness between the highest position of the developer layer and the surface of the developer carrier) by means of a control blade which is a layer thickness control member, and conveyed to developing region.

The gap between developing sleeve 21 and photoreceptor drum 10 in the developing region is maintained at 0.2–1.0 mm, which is more than the layer thickness (of the developer). Between developing sleeve 21 and photoreceptor drum 10, an A.C. bias voltage wherein A.C. voltage $V_{AC}$ is superimposed on D.C. voltage $V_{DC}$ is impressed. Since the toner charge has the same negative polarity as the D.C. voltage $V_{DC}$, toner which is repelled from the carrier will not adhere to portion $V_H$ having higher absolute potential values compared to D.C. voltage $V_{DC}$ on photoreceptor drum 10 but are adhered on a portion $V_L$ having lower absolute potential value compared to D.C. voltage $V_{DC}$ at an amount corresponding to the difference of potential with $V_{DC}$ and visualized (reversely developed).

After the latent image was visualized for the first color, the image forming process for the second color starts. The circumference of photoreceptor 10 is again uniformly charged by means of scorotron charger 12 again. A latent image based on image data for the second color is formed by means of laser writing device 13. Discharge by means of PCL 11, conducted in the image forming process for the first color, is not conducted again because the toner adhered on the image portion for the first color is scattered due to the abrupt reduction of the ambient potential.

Among the photoreceptor whose potential becomes $V_H$ all over the circumference of photoreceptor drum 10 again, in portions where there is no image for the first color, the same latent images as that for the first color is made and development is conducted. However, in portions where there are first color images and which will be subjected to image exposure to light and development again, latent images having potential $V_T$ whose absolute value is slightly higher than the above-mentioned $V_L$ are formed due to light-shielding by means of the toner adhered for the first color and electric charges of the toner itself. The latent images are developed under the condition corresponding to the potential difference between $V_{DC}$ and $V_T$. In portions where the image of the first color and the image of the second color are superposed, if the development for the first color is conducted wherein latent images whose potential is $V_L$ is made, balance of the potential between the first color and the second color is damaged so that the potential of the latent images may set to be intermediate potential $V_M$ ($V_H > V_M > V_H$) by reducing the exposure amount for the first color.

Also, for the third color and the fourth color too, the same image forming process as for the second color is conducted so that 4 colors toner images are formed on the circumference of photoreceptor drum 10. In this manner, photoreceptor drum 10 is subjected to transferring in the following transfer process.

On the other hand, recording paper P, which is fed from paper feeding cassette 40 synchronously for the toner images on the above-mentioned photoreceptor drum 10 by means of paper feeding rollers 41 and 42 and timing roller 43, is fed to a transfer region where the recording paper is brought into contact with the photoreceptor drum by means of transfer belt device 30 wherein transfer belt 31 is composed of an endless rubber belt having electrical resistance of $10^8$–$10^{14}\Omega\cdot$cm and thickness of 0.4–1.0 mm, and is fed to a transfer region where transfer electric field for transferring the toner images onto the photoreceptor drum on the recording paper is impressed, and then, multi-color toner images on the circumferential surface of photoreceptor drum 10 are transferred on recording paper P concurrently. Incidentally, the transfer belt, composed of an endless rubber belt having width wider than the width of the recording paper, conveys the recording paper into the transfer region by static-electrically adhering and conveys it out of the transfer region and, in the transfer region, presses the recording paper onto the photoreceptor drum at a specified pressure and provides a transfer electric field for transferring the toner images present on the photoreceptor drum onto the recording paper.

A high D.C. voltage is impressed onto shaft 32*a* in retention roller 32 on the upperstream side in the advancing direction of recording paper P on carried on transfer belt 31 bridged between retention rollers 32 and 33. Conductive brush 34 is located under a grounding status as a charge providing means to recording paper P, contacting the above-mentioned shaft 32*a* through transfer belt 31. Fed recording paper P advances between brush 34 and transfer belt 31. An electrical charge is impressed onto recording paper P by brush 34 so that adhesion force occurs between recording paper P and transfer belt 31. Following this, recording paper P advances to the nip portion (also known as the transfer region) formed by photoreceptor drum 10 and transfer belt 31. A transfer electric field is provided onto the recording paper from the reverse surface of transfer belt 31 by means of a corona discharger or alternatively a bias roller so that multi-color toner images are transferred onto recording paper P and subsequently copied.

After recording paper P is subjected to discharge by means of A.C. corona discharge by shaft 33*a* located in side retention roller 33 on the downstream of transfer belt 31 which acts as the counter electrode, or while being subjected to discharge by means of A.C. corona discharge, the recording paper is repelled from transfer belt 31. Numeral 37 is a cleaning blade, which removes toner adhered from rotating transfer belt 31. Transfer belt 31 of transfer belt device 30 rotates, during forming multi-color images, counter-clockwise driven by shaft 33*a* in retention roller 33 on the downstream side of transfer belt 31 as the rotation center so that it is separated from photoreceptor drum 10.

Recording paper P, separated from transfer belt device 30 and retaining multi-color toner images is conveyed to fixing device 50 composed of 2 pressing rollers having a heater at least inside of either roller or at outside vicinity position. By providing heat and pressure between 2 pressure rollers, the adhered toner is melted, and then, fixed onto recording paper P. Following this, the paper is ejected to tray unit 59 by means of paired ejection rollers 56, 57 and 58.

After residual toner, which remained on the circumference of photoreceptor drum 10 after transfer of the image, is subjected to neutralization by means of discharger 15 using an A.C. corona discharger, goes to cleaning device 16, where it is brushed off in cleaning device 16 by means of cleaning blade 16*a*, composed of rubber material, which is brought into contact with photoreceptor drum 10, and then, discharged by a screw or stocked there.

Photoreceptor drum 10, from which the residual toner was removed by means of cleaning device 16 is, then again, subjected to exposure to light by means of PCL 11. Following this, it is subjected to uniform charging by means of scorotron charger, and then, enters into the next image forming cycle. During forming multi-color toner images, cleaning blade 16*a* is separated from the surface of the photoreceptor and the A.C. discharge by means of discharger is inactivated.

Figure 2:
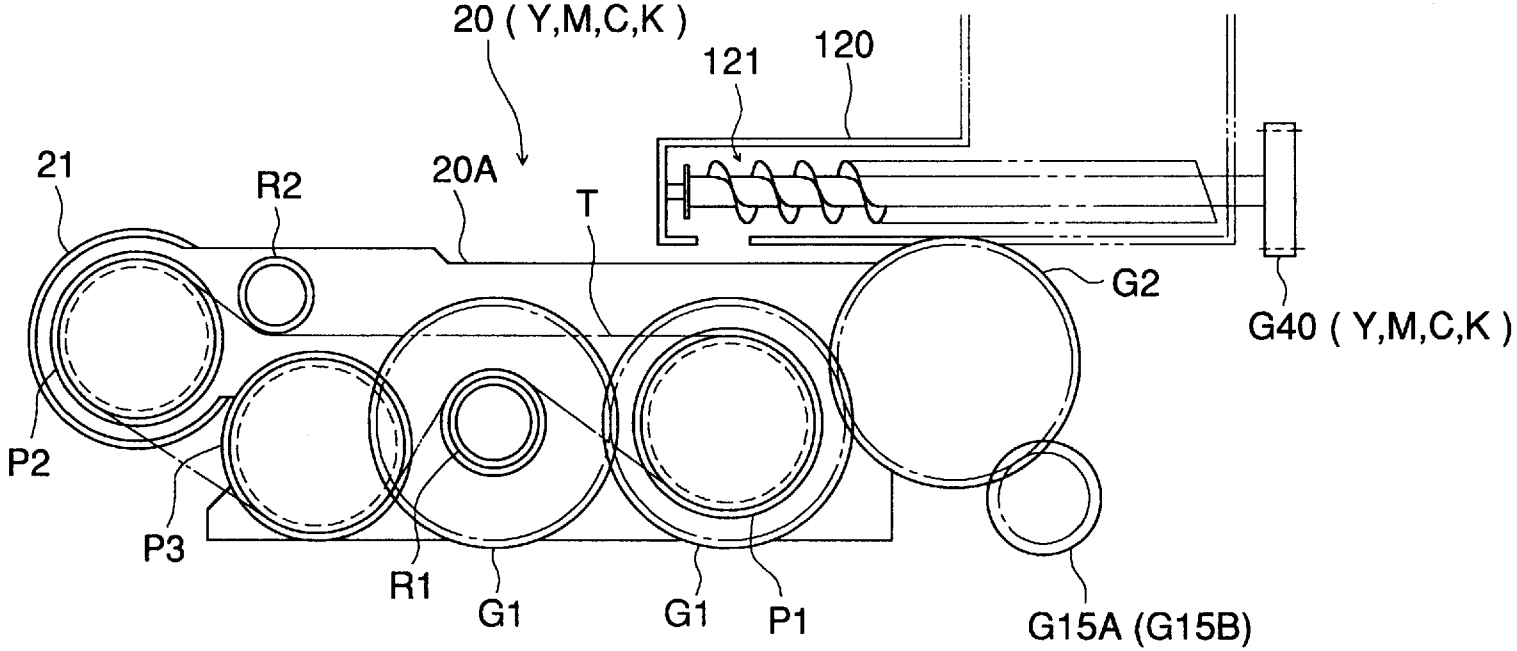
FIG. 2 is a drawing of developing devices and a toner hopper.

As shown in FIG. 2, on the side of developing container 20A, each of the above-mentioned developing devices 20 (Y, M, C, K) is equipped with built-in paired stirring members (not illustrated) and paired gears G1, integrally provided on the same shafts of the members respectively, which are engaged with each other so that each developing device is arranged to be rotated through gear G2 which connects to a developing device driving device described later.

In addition, each of the above-mentioned gears G1 is provided with pulley P1 and idling roller R1 integrally on respective shafts, and the above-mentioned developing sleeve 21 and a toner supplying roller (not illustrated) are equipped with pulley P2 and pulley P3 integrally on respective shafts. Through the above-mentioned pulleys P1, P2 and P3, timing belt T is bridged which is placed under tension by roller R2.

Therefore, when the above-mentioned gear G2 is rotated due to connection with the developing device driving device, a pair of stirring members are uniformly rotated in opposite direction each other so that the developer inside developing device 20A is conveyed and stirred in the vertical direction of the paper surface. The stirring members mixed the toner and the carrier in such a manner that the toner and the carrier are distributed uniformly. On the other hand, due to conveyance of timing belt t, developing sleeve 21 and a toner supplying roller are rotated so that development of latent images on photoreceptor drum 10 is started.

When each of the above-mentioned developing devices 20 continues the development of the latent images and consumes toner in the developer housed therein, sensing is conducted by means of a sensor means not illustrated so that it is so arranged that toner replenishment is automatically started from the toner hopper provided in each developing device 20 in such a manner that toner ratio in the developer is recovered to a prescribed ratio.

Toner replenishment to developer 20 is conducted by the use of the toner replenishing driving device of the present invention, such as by utilizing the thrust force due to the rotation of toner conveyance screw 121 inside replenishing tube 120 which is connected to the toner hopper to a prescribed direction.

Figure 3:
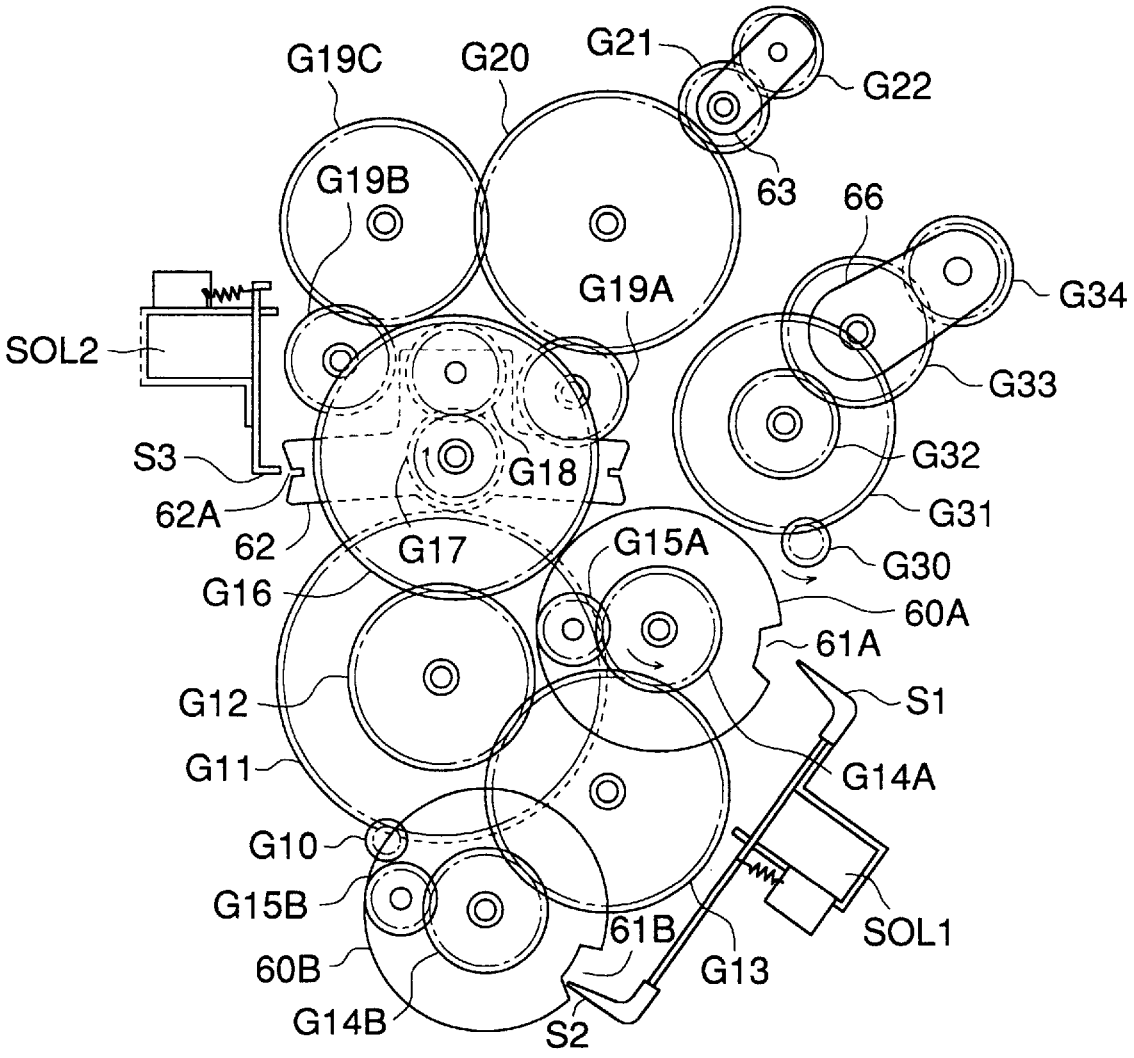
FIG. 3 is a block diagram of an operation system of a driving device of the present invention.

FIG. 3 shows the above-mentioned developing device driving device and a toner replenishing driving device of the present invention integral with the same.

Gear G10 of the driving motor (not illustrated) which is the driving source B is engaged with gear G11, and transfers rotation to gear G13 through gear G12 which is integral with the same shaft of the gear G11.

The above-mentioned gear G13 is engaged with gear G14A and gear G14B which are a pair of driven gears, and furthermore, the above-mentioned gears G14A and G14B are respectively equipped with discs 60A and 60B rotatably on the same shaft wherein a pair of gear G15A or G15B are respectively mounted rotatably on a shaft which is fixed thereto.

When gear G10 is rotated clockwise due to the forward rotation of the driving motor under a status that one coupling claw S1 provided on the actuator is withdrawn from notch 61A on one of disc 60A due to the action of solenoid SOL 1, the above-mentioned gear G14A is rotated counter-clockwise. Due to this, disc 60A is rotated counter-clockwise so that it engages gear G15A with gear G2 shown in FIG. 2. Thus, power is transferred to developing device 20 which houses a specific developer, for example, magenta. On the other hand, gear G15B on disc 60B whose rotation is prevented due to engagement of the other engaging claw S2 is idled so that power is not transferred thereto.

Under the above-mentioned status, if the driving motor is switched to reverse rotation, the rotation direction of gear G14A is changed to clockwise. As a result, due to clockwise rotation of disc 60A, gear G15A is engaged with gear G2 of developing device 20 in which a yellow developer, for example, is built-in so that power is transferred thereto.

On the other hand, when the other engaging claw S2 provided by the actuator is withdrawn from notch 61B on the other disc 60B due to the action of solenoid SOL 1 so that engagement of the above-mentioned engaging claw S2 to disc 60B is canceled, forward rotation, i.e., clockwise rotation results in the counter-clockwise rotation of gear G14B. As a result, disc 60B is rotated in a counter-clockwise direction. Consequently, gear G15B is engaged with gear G2 of developing device 20 in which black developer, for example, is built-in so that power from the driving motor is transferred to it. In addition, when the driving motor is switched to reverse rotation, disc 60B is rotated clockwise. As a result, gear G15B is engaged with gear G2 of developing device 20 in which a cyan developer (for example) is built-in so that power is transferred thereto. In this occasion, the above-mentioned engaging claw SI is coupled to notch 61A on disc 60A so that gear G15A is kept idled.

As described above, by switching the rotation of the driving motor and the action of solenoid SOL 1, each of the yellow, magenta, cyan and black developers respectively starts development subsequently in accordance with development timing.

The above-mentioned gear G12 is also engaged with gear G16 in a toner replenishing driving device so that it also utilizes the rotation of the above-mentioned driving motor as power for toner replenishing to each of the four developing devices 20 (Y, M, C, K).

The above-mentioned gear G16 has the same shaft with gear G17. In addition, aforesaid shaft rotatably supports supporting member 62 wherein gear G1 8 is rotatably mounted on a shaft which, in return, is fixed on the supporting member 62.

Figure 4:
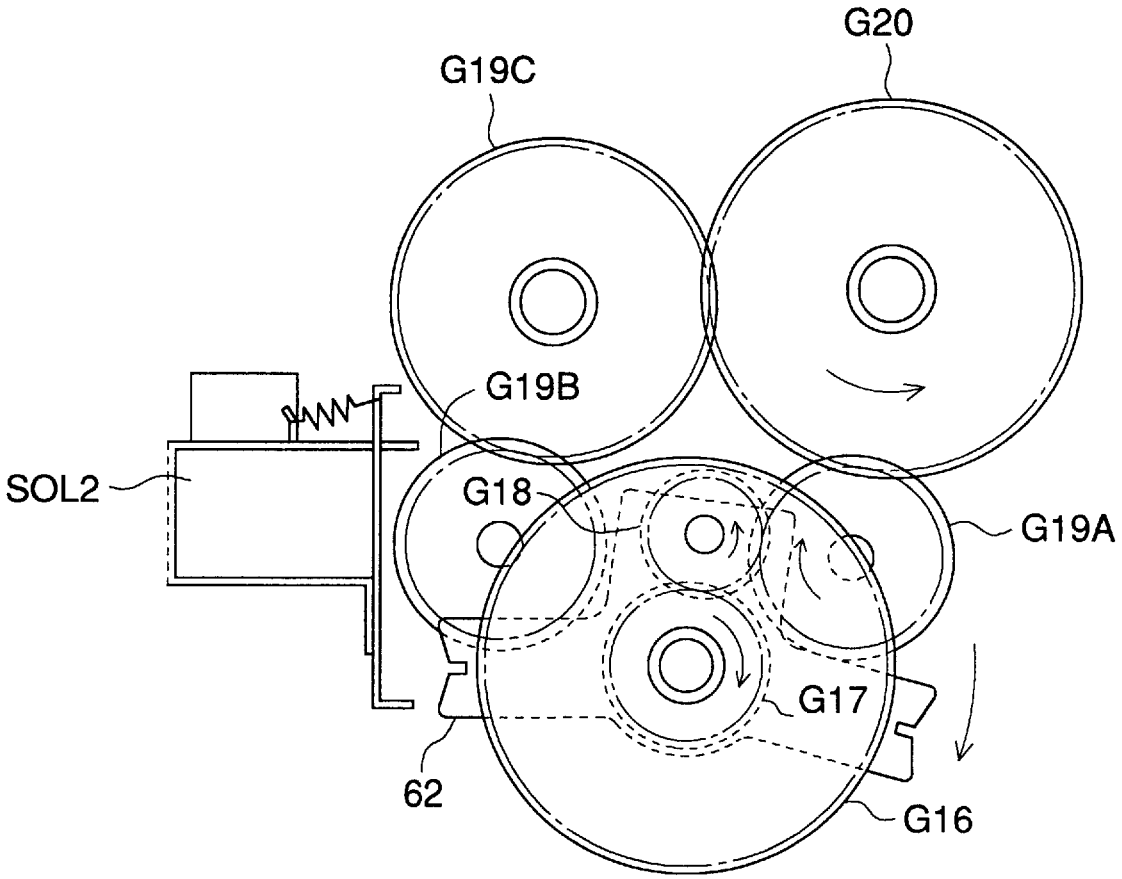
FIG. 4 is a drawing of an operation system of a toner replenishing driving device (No. 1).

The above-mentioned gears G17 and G18 are in relationship of a sun gear and a planetary gear. When gear G10 is rotated clockwise due to the forward rotation of the driving motor, due to the autorotation of gear G17 which is a sun gear, gear G18, which is a planetary gear, revolves clockwise due to the pivoting of supporting member 62 as shown in FIG. 4 so that it is engaged with gear G19A, which is the first transfer system. Through gear G19A, gear G18 rotates gear G20, the driven gear, in a counter-clockwise direction.

Figure 5:
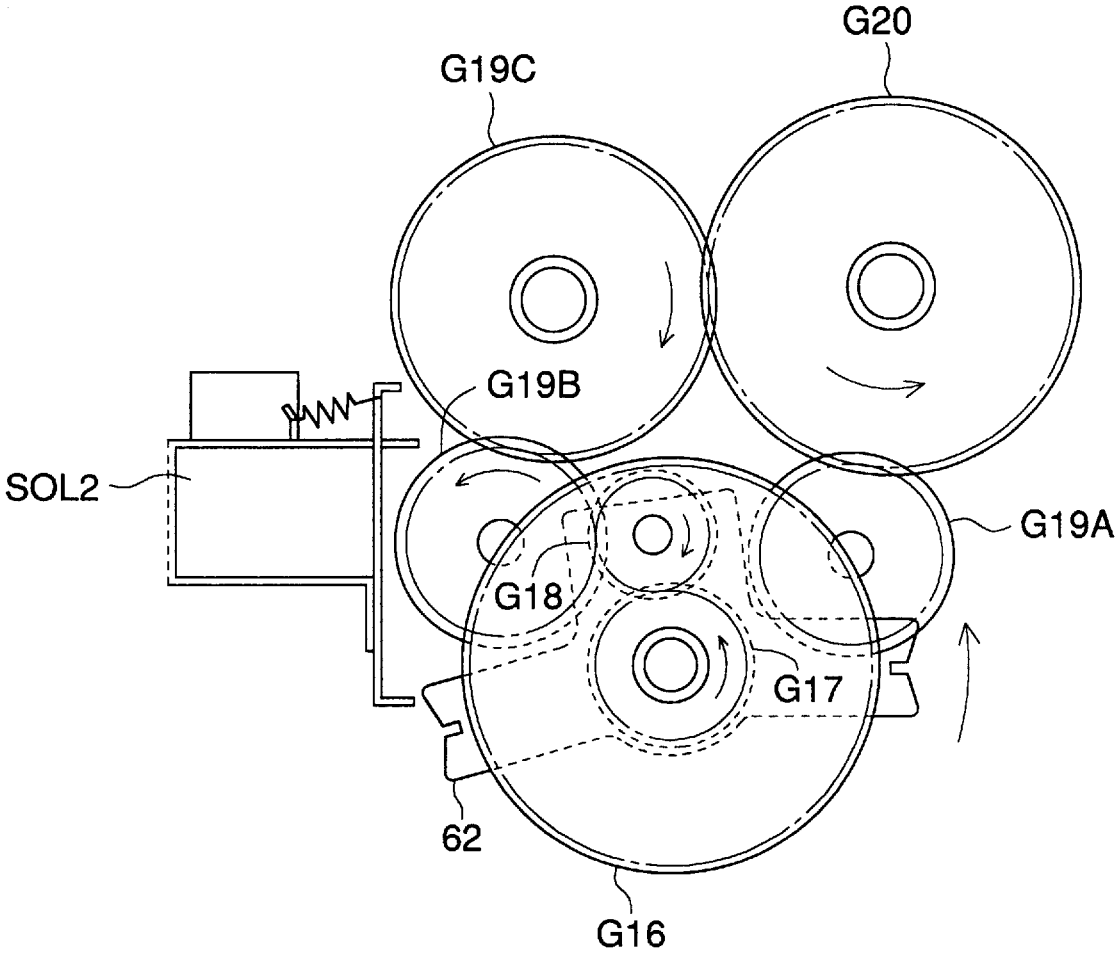
FIG. 5 is a drawing of an operation system of a toner replenishing device (No. 2).

When gear 10 is rotated counter-clockwise due the reverse rotation of the driving motor, due to the autorotation of gear G17 to a counter-clockwise direction, the above-mentioned gear G18 is revolved counter-clockwise, as shown in FIG. 5, after pivoting of supporting member 62, and engages with gear G19B, which is the second transfer system so that it rotates the above-mentioned gear G20 also in the counter-clockwise direction through intermediate gear G19C.

As described above, the above-mentioned gear G20 is always driven to be rotated counter-clockwise irrelevant to the switch of the rotation of the driving motor, in other words, during the operation of any of the four developing devices 20 (Y, M, C, K).

As shown in FIG. 3, gear G21 is engaged with the above-mentioned gear G21. In addition, gear G22 is engaged with gear G21, which is rotatably mounted on a shaft which is fixed on a shaft which is fixed on supporting plate 63 which freely pivots with the rotation center of G21 as a fulcrum.

Figure 7:
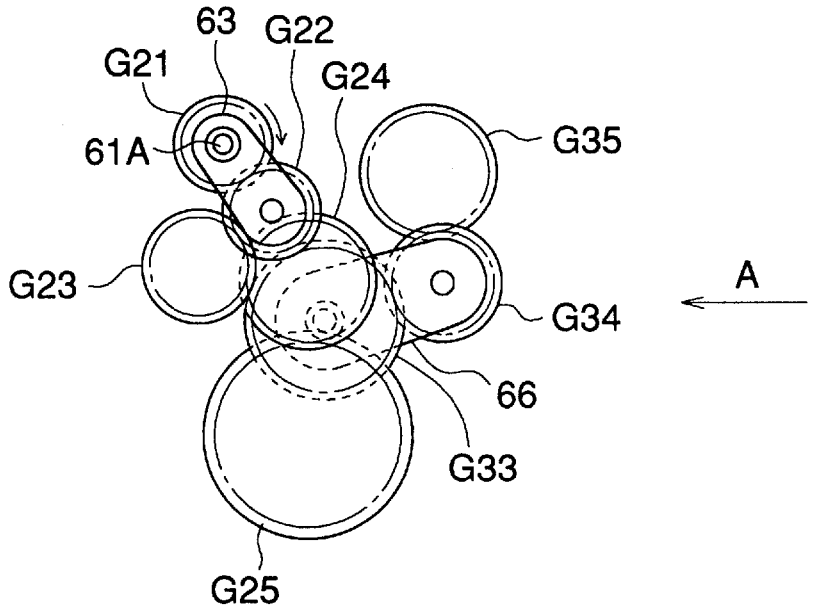
FIG. 7 is a drawing of an operation system of a toner replenishing driving device (No. 4).

Rotation of the above-mentioned gear G20 in a counter-clockwise direction is transferred to the above-mentioned gear G21 to form a clockwise rotation to it. As a result, as shown in FIG. 7, the above-mentioned supporting plate 63 rotates clockwise, and concurrently with this, it transfers power to gear G22 so that it drives and rotates gear G25 through gears G23 and G24.

Examples 1 and 2 for attaining the first object of the present invention will now be explained.

(EXAMPLE 1)

Example 1 will be explained referring to FIG. 3 through FIG. 10.

Figure 8:
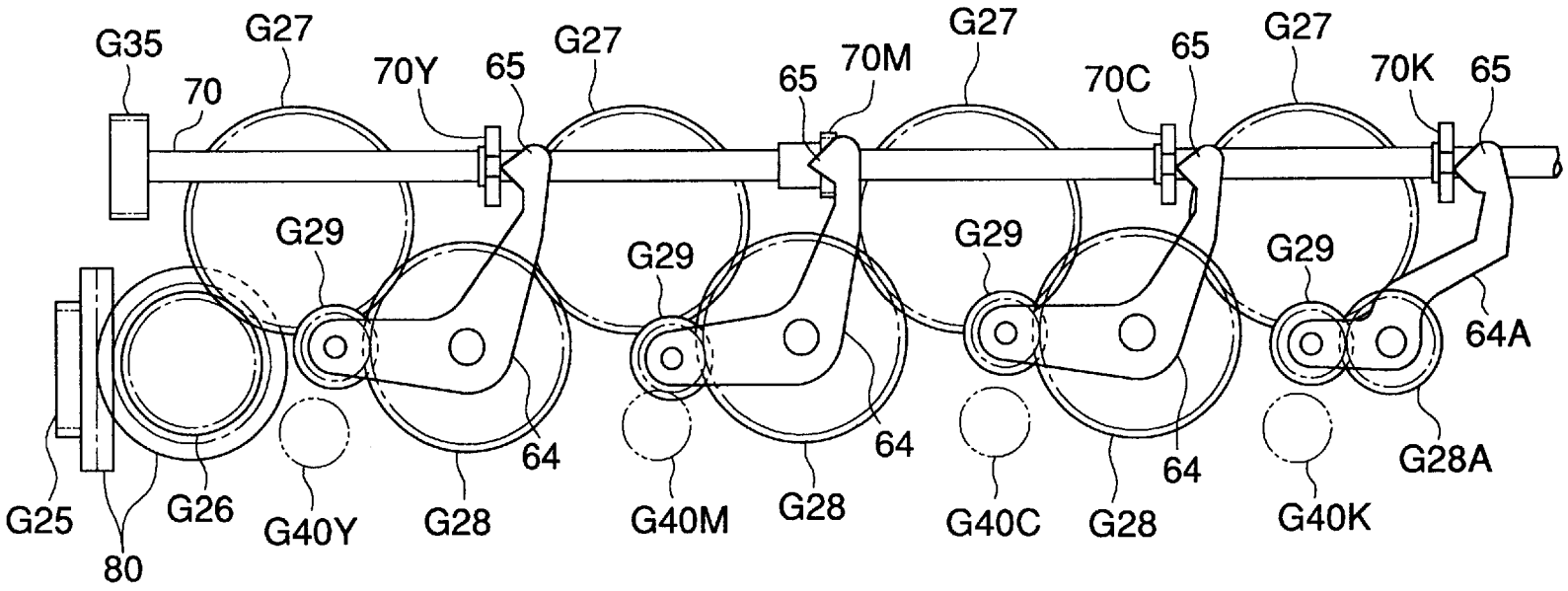
FIG. 8 is a schematic diagram of the control system of a toner replenishing driving device FIG. 9 (*a*) shows a cam member, and FIGS. 9(*b*) through 9(*e*) show the phases of the cam members.

FIG. 8 shows a major portion of a toner replenishing driving device viewed from an arrow "A" direction in FIG. 7. The rotation of the above-mentioned gear G25 is transferred to gear G26 positioned at a right angle to gear G25 through, for example, paired bevel gears 80. The rotation is further transferred to 4 gears G28 to G28A through plural intermediate gears G27.

The above-mentioned gears G28 to G28A are respectively equipped with supporting levers 64 to 64A which respectively rotate freely on the center of the rotation of the above-mentioned gears as a fulcrum as a revolution-control means for planetary gears. The supporting levers 64 are respectively provided with protrusion 65 on one end and also provided with gears G28 at the other end and gear G29, which is a planetary gear, engaging gears G28A.

The above-mentioned toner replenishing driving device is further provided with a stepping motor as a driving source A for toner replenishment control use. Gear G30, shown in FIG. 3, of the control motor (not illustrated)rotates counter-clockwise in response to the replenishing signal for the toner, and also drives and rotates gear 33 in a counter-clockwise direction through gears G31 and G32 whose shafts are the same.

The above-mentioned gear 33 is engaged with gear G34 which is rotatably mounted on a shaft which is fixed on supporting plate 66, which freely pivots on the center of the rotation of gear 33 as a fulcrum. Rotation of the counter-clockwise direction of gear G33 results in, as shown in FIG. 7, rotation of the above-mentioned gear G34 counter-clockwise so that power is transferred to gear G35.

The above-mentioned gear G35 is provided with 4 cam members 70Y, 70M, 70C and 70K wherein phase of notch is different from each other by ⅕ turn as shown in FIGS. 9(*a*)–9(*e*) as a cam mechanism on a shaft whose shaft is the same as gear G35 as shown in FIG. 8. In accordance with the color of toner, the above-mentioned motor for control rotates by a prescribed number so that the above-mentioned each cam member is rotated by ⅕ turn.

For example, when a toner replenishing signal to developing device 20M in which the magenta developer is built-in is inputted, due to driving of the above-mentioned control motor, cam member 70M is rotated so that notch 170M is caused to face protrusion 65 on the above-mentioned supporting lever 64.

As a result, the above-mentioned gear G29 revolves around gear G28, and is engaged with gear G40M (which is also illustrated in FIG. 2 too) which is integral to magenta toner conveyance screw 121, which is a driven gear, so that toner conveyance to developing device 20M is started. On the other hand, any of cam members 70Y, 70C and 70K, except for cam member 70M, is not caused to face protrusion 65 with respective lever 64. Therefore, gears G29 are not engaged with gears 40Y, 40C or 40K provided with its respective toner conveyance screws 121. Accordingly, toner is not replenished for any of yellow, cyan and black developing devices 20 (Y, M, C, K).

As described above, due to change in the phase of the notch of cam members 70Y, 7 0M, 70C and 70K, toner replenishment to each developing device 20 (Y, M, C, K) is conducted alternately as appropriate.

Since the driving power for toner replenishment can surely be transferred due to the engagement of various gears, more stable toner replenishing function can be obtained compared to a transfer method employing a clutch mechanism.

Figure 6:
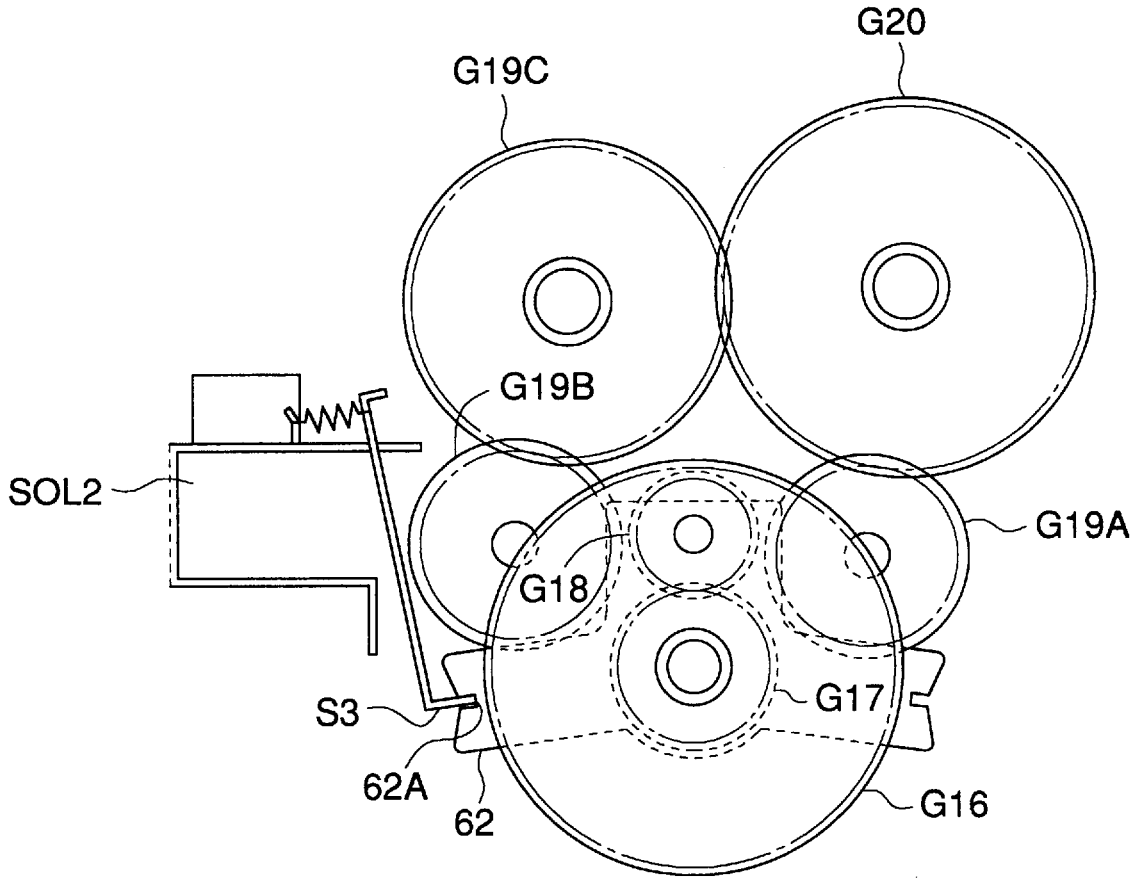
FIG. 6 is a drawing of an operation system of a toner replenishing driving device (No. 3).

Incidentally, when forming a monochrome image by means of developing device 20 (Y, M, C or K), at time in which a prescribed amount of toner replenishing is completed, the above-mentioned gear G18 is caused to be in a neutral state, as shown in FIG. 6, wherein gear G18 is not engaged with either gear G 19A or G19B, due to temporary reversing of the above-mentioned driving motor. Concurrently with this, solenoid SOL2 is deactivated so that catching claw S3, which is an interference means, is caused to engage with notch 62A in the above-mentioned supporting member 62. Thus, actuation of toner replenishing can be interrupted while the above-mentioned gear G18 is neutralized.

Figure 10:
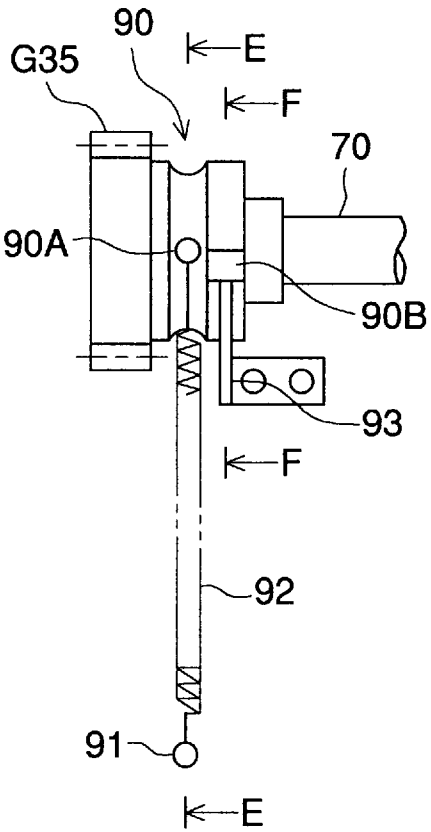
FIGS. 10(*a*) through 10(*c*) are explanatory drawings showing an initial-position setting mechanism.
Figure 10:
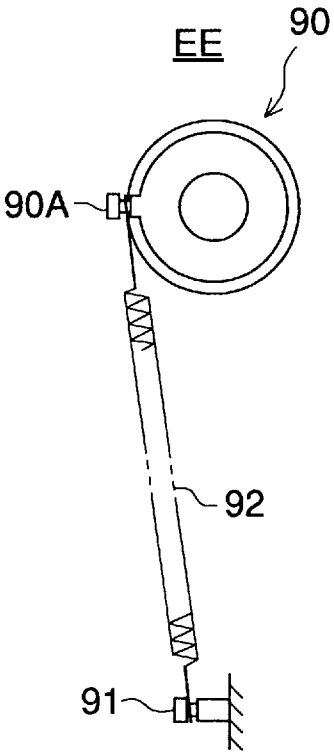
Figure 10:
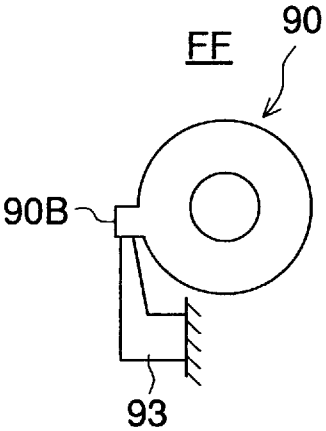

In addition, as shown in FIGS. 10(*a*)–10(*c*), as a restoring means to the initial phase, the above-mentioned shaft 70 is integrally equipped with spring-anchoring pin 90A in a groove and protrusion 90B on a circumferential portion of rotation control member 90.

The rotation-control member 90 is arranged in such a manner that it is given forces to rotation to the reverse direction of shaft 70 due to the pulling effect of spring 92, which is positioned between the spring-anchoring pins 90A and 91 mounted on the apparatus main body side and that rotation is controlled due to that the protrusion 90B is brought into contact with stopper 93 on the apparatus main body side so that the each cam member is set to their initial positions.

Due to the rotation of gear G30 on control motor shown in FIG. 3, the shaft 70 subsequently rotates by ⅕ turn in accordance with the tension of pulling spring 92 so that toner is appropriately replenished to each developing device. When toner replenishment to each developing device has been completed and gear G30 is reversely rotated, engagement between gear G34 and gear G35 is canceled, shaft 70 automatically rotates to the reverse direction due to the force of the pulling spring and, as shown in FIGS. 10(*a*)–10(*c*), the protrusion 90B is brought into contact with stopper 93 so that each cam member returns to the initial phase again.

Accordingly, with regard to the rotation angle of each cam member, by stipulating the number of rotations of the control motor from the initial phase with an angle, angle necessary for each toner replenishing can correctly be set.

(EXAMPLE 2)

Example 2 will now be explained referring to FIGS. 11 and 12.

Gear G30 on the control motor (not illustrated), which is a driving source A rotating forwardly and reversely, is engaged with gear G31. Gear G32, which is provided integrally with gear G31, is engaged with sun gear G33. In addition, on the circumference of sun gear G33, planetary gear G34, capable of revolving on the center rotation shaft of sun gear G33, is provided. When gear G30 is rotated counter-clockwise, sun gear G33 also rotates counter-clockwise. Planetary gear G34 also revolves counter-clockwise. Planetary gear G34 is engaged with gear G35 so that power is transferred. Due to the transfer of power to gear G35 and the following gears, toner replenishment, explained in Example 1, is controlled.

When gear G30 rotates clockwise, process control is conducted. Namely, gear G36, mounted on the same shaft as of disc cam 100, is provided at th e symmetric position from gear G35. When gear G30 is rotated clockwisely due to the switch of the rotation direction thereof, the supporting plate 66 rotates clockwise so that gear G34 is engaged with the gear G36, and then, the above-mentioned disc cam 100 is rotated ½ turn from the angle shown in FIG. 11 to the angle shown in FIG. 12.

Figure 11:
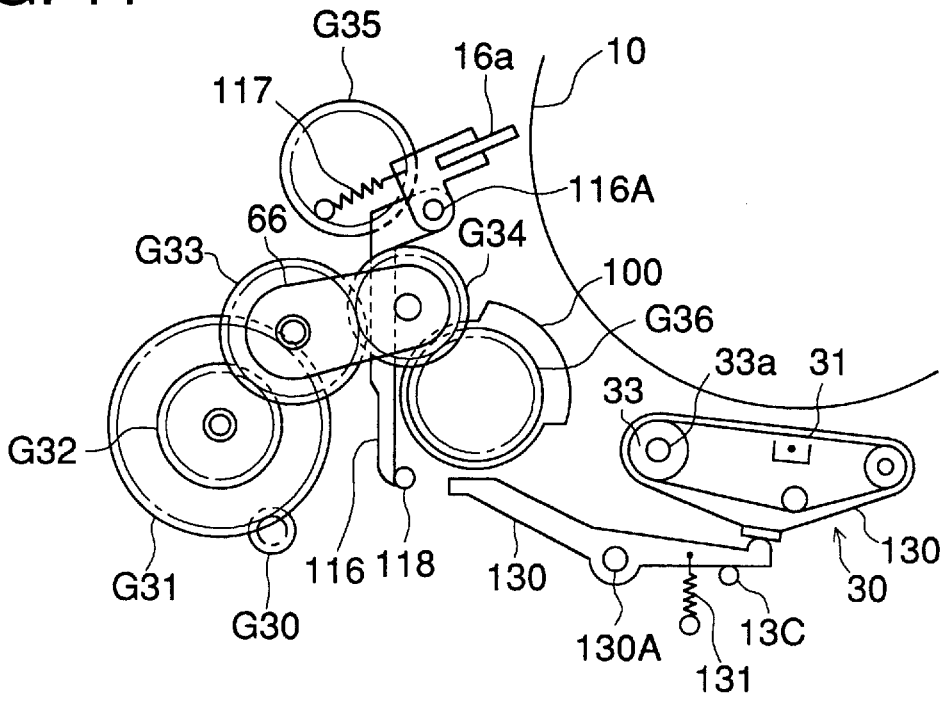
FIG. 11 shows an operation drawing of an image forming processing means (No. 1).

In the course of advancing the image forming apparatus process, as shown in FIG. 11, the transfer belt device 30 rotates clockwise, due to its own weight, on shaft 33*a* on retention roller 33 as a fulcrum so that transfer belt 31 is caused to be separated from the circumference of photoreceptor drum 10 on the other hand, the cleaning blade 16*a* rotates in a counter-clockwise direction, due to the force of pulling spring 117, with shaft 116A as a fulcrum so that it is withdrawn from the circumference of photoreceptor 10.

Figure 12:
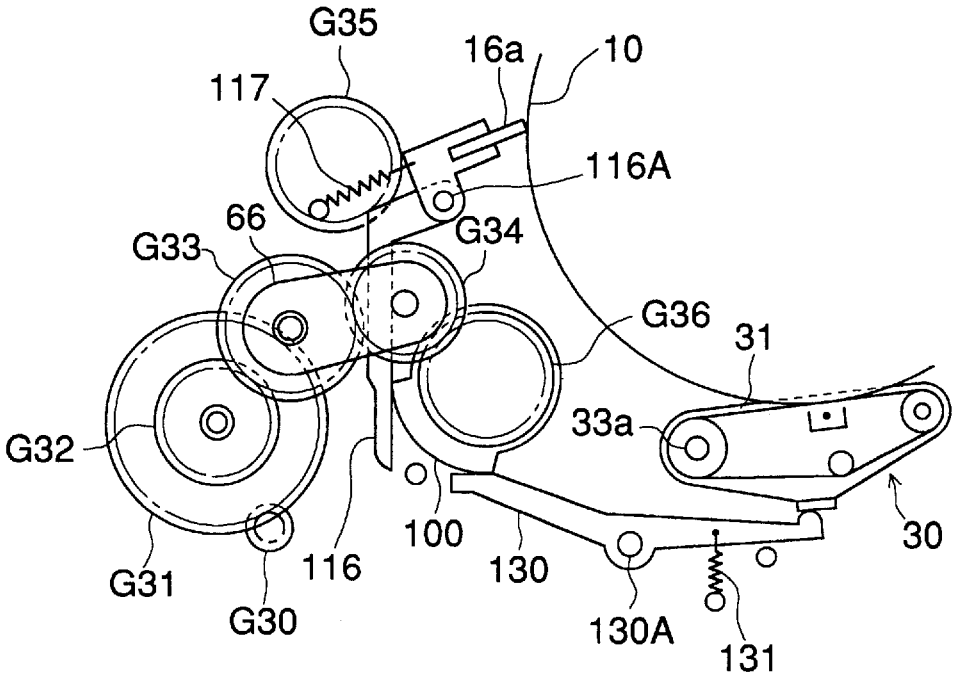
FIG. 12 shows an operation drawing of an image forming processing means (No. 2).

When the disc cam 100 is rotated to the angle shown in FIG. 12, due to the completion of the image forming process, it presses operation lever 116 which is provided integrally with cleaning blade 16*a* so that cleaning blade 16*a* is rotated in a clockwise direction. The edge of the cleaning blade is caused to be brought into press contact with photoreceptor drum 10, and then, cleaning operation is started utilizing the elasticity of the blade itself.

Concurrently with above, the disc cam 100 presses operation lever 130 which supports transfer belt device 30, and rotates operation lever 130 in a counter-clockwise direction against the force of pulling spring 131 with shaft 130A as a fulcrum.

As a result, transfer belt device 30 is pivoted in a counter-clockwise direction on the shaft 33*a* as a fulcrum so that the circumference of transfer belt 31 is brought into pressure contact with the circumference of photoreceptor drum 10, forming a transfer region where images are transferred onto the recording paper.

Owing to the present invention, plural development devices and plural toner replenishing device equipped in a color image forming apparatus can be operated with a common driving motor as a power source and controlled. As a result, a driving device in a compact image forming apparatus wherein manufacturing cost is inexpensive can be provided.

Example 3 for attaining the second object will now be explained as follows.

Figure 13:
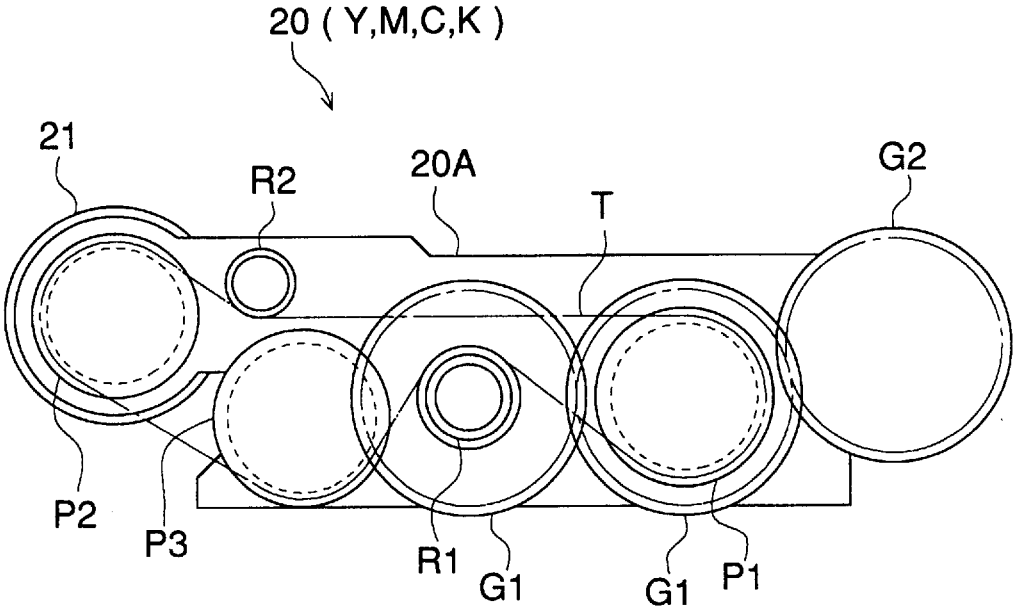
FIG. 13 As a side view showing a driving system of the developing devices in Example 3.

As shown in FIG. 13, on the side surface of developing container 20A, each of the developing devices 20 (Y, M, C and K) is equipped with a built-in paired stirring member (not illustrated) and a pair of gears G1, integrally provided on the same shafts of the stirring members respectively, which are engaged with each other, so that each developing device is arranged to be rotated through gear G2 which connects to a developing device driving device, described later.

In addition, each of the above-mentioned gears G1 is provided with pulley P1 and idle roller R1 integrally on the same shaft, and the above-mentioned developing sleeve 21 and a toner supplying roller (not illustrated) are equipped with pulley P2 and pulley P3 integrally on the same shaft. Through the above-mentioned pulleys P1, P2 and P3, timing belt T is threaded and which is provided with tension roller R2.

Therefore, when the above-mentioned gear G2 is rotated due to connection with the developing device driving device, a pair of stirring member is rotated at a constant rate in a counter direction to each other so that the developer inside developing device 20A is conveyed and stirred in the vertical direction of the paper surface. The stirring members mixed in such a manner that the toner and the carrier are distributed uniformly. On the other hand, due to conveyance of timing belt T, developing sleeve 21 and the toner supplying roller are rotated so that development of latent images on photoreceptor drum 10 is started.

Figure 14:
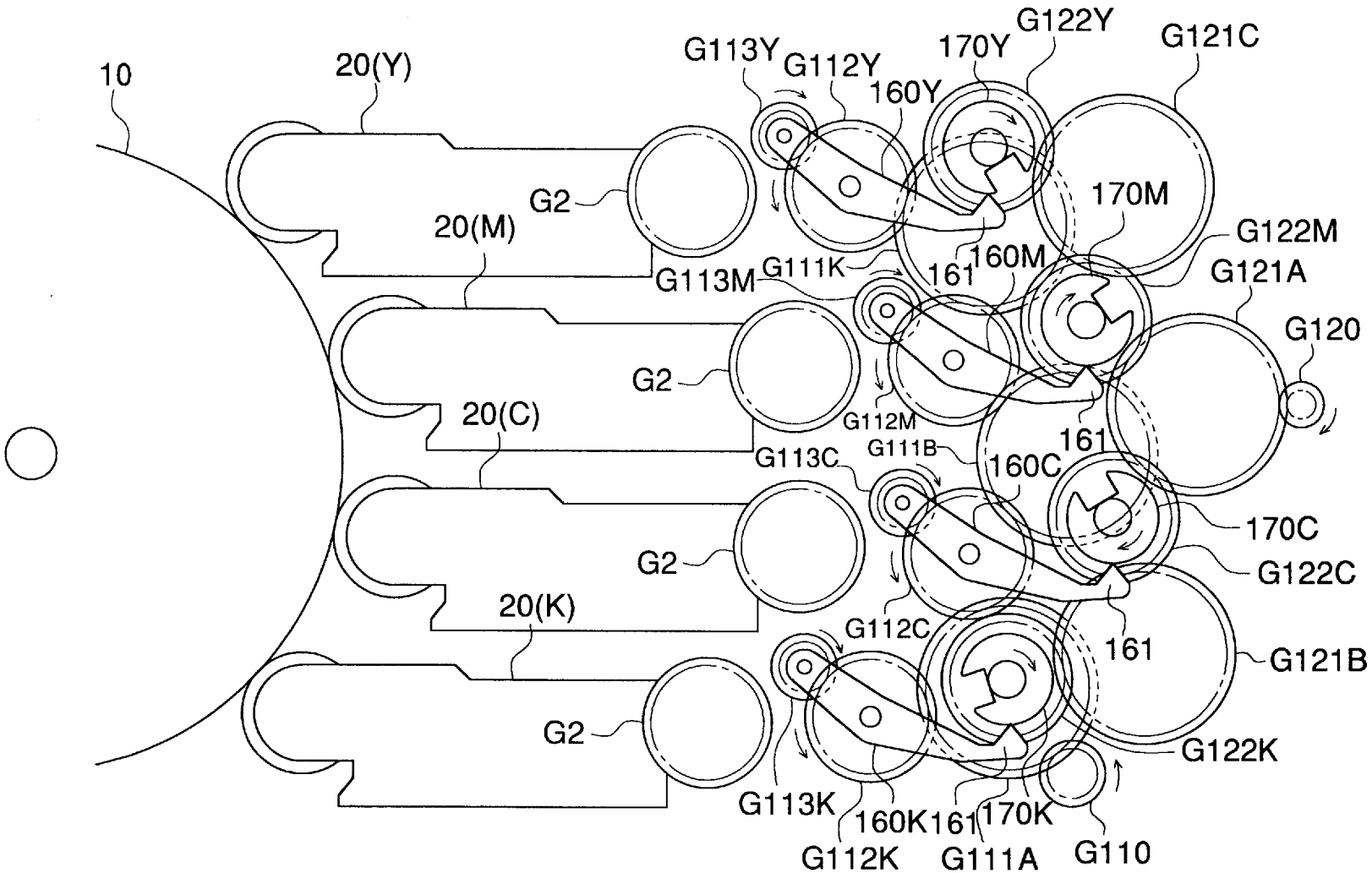
FIG. 14 is a schematic diagram showing a driving system of the developing devices in Example 3.

FIG. 14 shows a structure of the above-mentioned developing device driving device. Driving gear G110 on the first motor (not illustrated), which is the driving power source of the developing device 20 (Y, M, C and K) which is the first driving source of aforesaid device is engaged with sun gear G112K, through intermediate gear G111A, which is coaxially and rotatably mounted on a shaft which is fixed on supporting lever 160K. In addition, the sun gear G112C is engaged with sun gear 112M through intermediate gear G111B, which is coaxially and rotatably mounted on a shaft which is fixed on supporting lever 160M. Further, the above-mentioned sun gear G112M is engaged with sun gear G112Y, through intermediate gear G111K, which is coaxially and rotatably mounted on a shaft which is fixed on supporting lever 160Y.

Each of the above-mentioned supporting levers 160Y, 160 l, 160C and 160K is respectively provided with, at its one end, planetary gear s G113Y, G113M, G113C and G113K which are revolutionably engaged with sun gears G112Y, G1l2M, G112C and G112K respectively which are rotatably mounted on a shaft which is fixed on respective supporting lever.

each of the above-mentioned intermediate gears 111A, 111B and 111K, each sun gear and each planetary gear respectively have the same number of teeth so that the above-mentioned each sun gear is rotated in a counter-clockwise direction at an equivalent rate each other and each planetary gear is rotated in a clockwise direction at the same rate as above, both actions are due to the counter-clockwise direction rotation of the above-mentioned driving gear G120.

On the other hand, gear G120 on the second motor (not illustrated), which is used for switching operation of the developing devices, in the driving device which is the second driving source is engaged with gear G122M, which integrally has the same shaft with cam member 170M, through intermediate gear G121A, and also is engaged with gear G122C, which integrally has the same shaft as cam member 170C, through intermediate gear G121A. In addition, the above-mentioned gear G122M is engaged with gear G122Y, which integrally has the same shaft with cam member 170Y, through intermediate gear G121C. On the other hand, gear G122C is engaged with gear G122K, which integrally has the same shaft as cam member 170K, through intermediate gear G121B.

Each of the above-mentioned intermediate gears 121A, 121B and 121C and each gear respectively have the same number of teeth so that the above-mentioned each cam member is rotated in a clockwise direction at an equivalent rate due to the clockwise direction rotation of the above-mentioned driving gear G120.

Each of the above-mentioned supporting lever 160 (Y, M, C and K), due to inertia following rotation of each sun gear G112 (Y, M, C and K) and the weight of each planetary gear G113 (Y, N, C and K), is given force in such a manner as to be rotated in a counter-clockwise direction. Each protrusion 161 at the other end of the supporting lever 160 (Y, M, C, K) is respectively brought into contact with the circumferential surface of the above-mentioned cam members 170 (Y, M, C and K) so that their rotation angle is limited. Due to this, the revolution of each planetary gear G 113 (Y, M, C and K) is limited so that they are respectively kept at a position separated from gear G2 in its corresponding developing device 20 (Y, M, C, K). Thus, each supporting lever 160 (Y, M, C and K) is used as a revolution-controlling means for each planetary gear G113 (Y, M, C and K).

Figure 15:
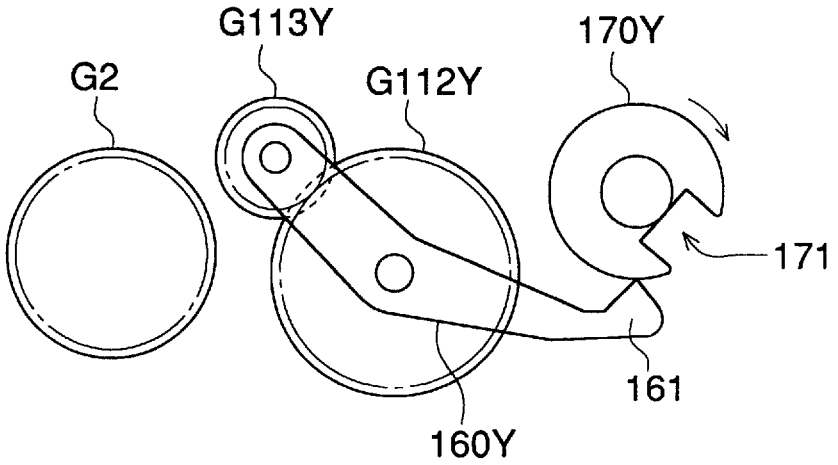
FIGS. 15(*a*) and 15(*b*) are drawings showing a relationship between a supporting lever and a cam member in Example 3.
Figure 15:
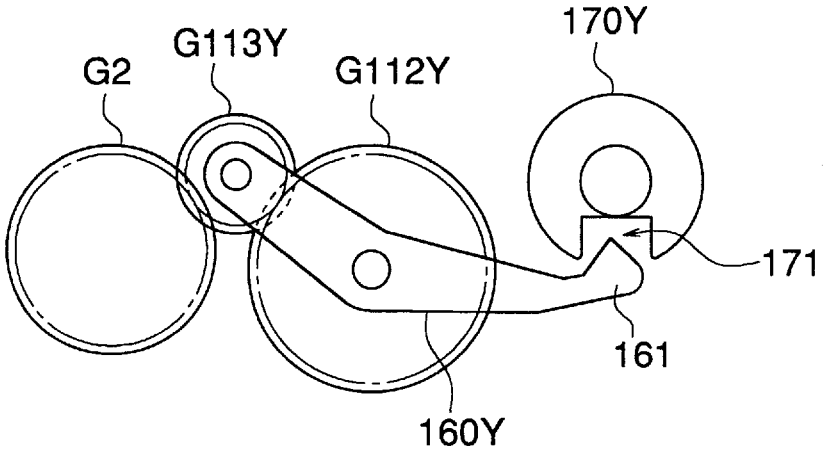

Each of the above-mentioned cam members 170 (Y, M, C and K) are respectively provided with notch 171, on its circumferential surface, enabling it to be coupled with protrusion 161 on 160Y, for example, as shown in FIGS. 15(*a*) and 15(*b*), wherein the phases of cam members 170Y, 170M, 170C and 170K are different in this order in a counter-clockwise direction.

The initial position of notches 171 on each cam member 170 (Y, M, C and K) is controlled. When the developing process is non-operational, as shown in FIG. 15(*a*), notch 171 on, for example, cam member 170Y is positioned on slightly behind following protrusion 161 of supporting lever 160Y.

When starting the operation of developing process, the above-mentioned first motor is actuated so that each planetary gear G113 (Y, M, C and K) starts its rotation all at once due to the driving of driving gear G110. Parallel to this, the second motor is actuated so that each cam member 170 (Y, M, C and K) starts its rotation in a clockwise direction due to the driving of driving gear G120.

Due to a prescribed amount of rotation of the second motor, notch 171 on cam member, for example, 170Y is coupled to protrusion 161 in supporting lever 160Y, and the operation of developing device 20(Y) is interrupted while it is engaged with gear G2 due to the rotation of supporting lever 160Y in a counter-clockwise direction. Due to this, development operation of yellow latent images on photoreceptor drum 10 by means of developing device 20(Y) is continued.

Following the completion of the development of yellow latent images, the second motor re-starts operation so that supporting lever 160Y is rotated in a clockwise direction due to forcedly canceling coupling of protrusion 161 on notch 171 due to the rotation of cam member 170Y. Due to this, engagement of planetary gear G113Y and gear G2 is canceled so that operation of developing device 20(Y) stops.

Next, due to a prescribed amount of rotation of the second motor, notch 171 on cam member 170M is coupled to protrusion 161 on supporting lever 160M, and the operation of developing device 20(M) stops again while it is engaged with gear G2 due to the rotation of supporting lever 160M in a counter-clockwise direction. Due to this, development operation on magenta latent images on photoreceptor drum 10 by means of developing device 20(M) is continued.

Next, due to a prescribed amount of rotation of the second motor, notches 171 on cam members 170C and 170K are successively coupled to protrusion 161 on supporting lever 160C and 160K respectively, and, in a similar manner as above, each planetary gears G113C and G113K are respectively engaged with gears G2 in developing devices 20(C) and 20(K) in accordance with a prescribed timing intervals so that each latent image correspondingly to cyan and black is developed. Due to their superposing, full color toner images are formed.

As described above, if driving power is transferred using sun gears, planetary gears and cam mechanisms and selecting plural toner replenishing devices or plural developing devices, inexpensive driving device can be realized.

In addition, reliability of this mechanism is noticeably superior compared to a spring clutch. In addition, since electrical wiring is not necessary, its structure can be more simple compared to an electromagnetic clutch.

what is claimed is:

1. A driving device for a plurality of rotatable members of an image forming apparatus comprising:

a driving means;

a plurality of sets of sun gears and a plurality of sets of planetary gears, wherein said driving means engages said plurality of sun gears, and transmits a driving force thereto;

a plurality of follower gears each engaging said plurality of rotatable members, through which said driving force is transmitted thereto, wherein each said follower gear is engaged by one of said planetary gears when said planetary gears revolve around a corresponding sun gear, and is rotated by said planetary gear when said planetary gear rotates around its axis while engaging each corresponding follower gear;

a revolution control for controlling each said planetary gear rotatably around said sun gear; said revolution control comprising:

a plurality of supporting members, each supporting a first planetary gear of said plurality of planetary gears, said first planetary gear being adapted to revolve around a first sun gear of said plurality of sun gears; and a cam mechanism for engaging a portion of each supporting member and for controlling a revolution of said first planetary gear rotatably around said first sun gear, wherein said cam mechanism comprises a rotatable cam shaft, a plurality of cams being provided on said rotatable cam shaft, and a cam driving gear on said rotatable cam shaft.

2. The driving device of claim 1, wherein each rotatable member corresponds to each of a plurality of toner replenishing means of said image forming apparatus.

3. The driving device of claim 1, wherein each totable member corresponds to each of a plurality of developing means of said image forming apparatus.

4. The driving device of claim 1 wherein said rotatable cam shaft has a home phase, and said driving device further comprising:

a second driving means for driving said cam shaft through said cam driving gear;

a drive releasing means for releasing a transmission between said second driving means and said cam shaft; and a phase restoring means for restoring said cam shaft to said home phase when said drive releasing means releases said transmission.

5. The driving device of claim 4, wherein said phase restoring means comprises an elastic member for restoring said cam shaft to said home phase by means of elasticity of said elastic member.

6. The driving device of claim 5, wherein said phase restoring means further comprises a stopper for stopping said cam shaft at said home phase with said elastic member.

7. The driving device of claim 4, wherein said second drive means is capable of forwardly or reversely rotating, and said drive releasing means comprises a second sun gear connected to said second drive means to be driven by said second drive means, a second planetary gear engaged with said second sun gear to be revolved on an axis thereof or revolved round said second sun gear by said second sun gear, a second follower gear provided on said cam shaft, wherein said second follower gear comes in engagement with said second planetary gear when said second planetary gear revolves round said second sun gear, and said second follower gear is driven by said second planetary gear when said second planetary gear revolves on the axis thereof.

8. The driving device of claim 4 wherein said second driving means is adapted to forwardly or reversely rotate, and said drive releasing means comprises a sun gear for toner selection connected to and driven by said second driving means, a planetary gear for toner selection engaged by said sun gear for toner selection adapted for rotation about an axis thereof or revolution around said sun gear for toner selection, wherein said cam driving gear engages said planetary gear for toner selection when said planetary gear for toner selection revolves around said sun gear for toner selection, and said cam driving gear is driven by said planetary gear for toner selection when said planetary gear for toner selection rotates about its axis.

9. The driving device of claim 8 comprising:

a process change gear engaging said planetary gear for toner selection when said sun gear for toner selection rotates reversely, for driving a copying process mechanism.

10. The driving device of claim 1 comprising a plurality of intermediate gears engaged between each said first sun gear and said driving means so that each said first sun gear of said plurality of sun gears is driven by said driving means through said plurality of intermediate gears, and each said first sun gear of said plurality of sun gears rotates in a same direction.

11. A driving device for a plurality of rotatable members of an image forming apparatus comprising:

a driving means;

a plurality of sets of sun gears and a plurality of sets of planetary gears, wherein said driving means engages said plurality of sun gears, and transmits a driving force thereto;

a plurality of follower gears each engaging said plurality of rotatable members, through which said driving force is transmitted thereto, wherein each of said plurality of follower gears is engaged by one of said planetary gears when said planetary gears revolves around a corresponding sun gear, and is rotated by said one of said planetary gears when said one of said planetary gears rotates about an axis thereof while engaged with each corresponding follower gear;

wherein said driving force is transmitted to said plurality of rotatable members of a plurality of developing means and said plurality of rotatable members of a plurality of toner replenishing means;

a revolution control for controlling each said planetary gear rotatable around said sun gear, wherein said driving means is capable of revolving forwardly or reversely, said driving device further comprising:

a sun gear of said plurality of sun gears being rotated by said driving means, a planetary gear of said plurality of planetary gears engaged by said sun gear, a holding member coaxially revolvable around said sun gear for rotatably holding said planetary gear;

a first transmission gear train engaging said planetary gears for forwardly revolving a follower gear of said plurality of follower gears engaging said first transmission gear train when said driving means revolves forwardly; and a second transmission gear train engaging said planetary gears for reversely revolving said follower gear engaging said second transmission gear train when said driving means revolves reversely, whereby said follower gears can all be rotated in the same direction to transmit said driving force to said plurality of rotatable members for said plurality of toner replenishing means, irrespective of either a forward or reverse rotating direction of said driving means.

12. The driving device of claim 11, wherein a number of said first transmission gear train is different from a number of said second transmission gear train.

13. The driving device of claim 11 further comprising:

blocking means for blocking movement of said holding member so that said planetary gear is set at a position where said planetary gear is not engaged with either said first transmission gear train or said second transmission gear train.

* * * * *